United States Patent [19]

Thaxton

[11] Patent Number: 4,592,547

[45] Date of Patent: Jun. 3, 1986

[54] TENNIS PRACTICE AND GAME APPARATUS

[76] Inventor: George K. Thaxton, 758 S. County Rd., Palm Beach, Fla. 33480

[21] Appl. No.: 646,807

[22] Filed: Sep. 4, 1984

[51] Int. Cl.[4] ..... A63B 61/00

[52] U.S. Cl. ..... 273/29 A; 273/394; 273/402

[58] Field of Search ..... 273/30, 181 A, 184 R, 273/182 R, 185 R, 400, 401, 176 FB, 402, 407, 176 R, 177 A, 181 R, 181 F, 181 J, 181 K, 382, 394, 395, 396, 397, 398

[56] References Cited

U.S. PATENT DOCUMENTS

| | | | |
|---|---|---|---|
| 179,150 | 6/1870 | Belknap | 273/396 |
| 250,948 | 12/1881 | Murphy | 273/396 |
| 768,397 | 8/1904 | Norton et al. | 273/394 |
| 858,990 | 7/1907 | Kemper | 273/402 |
| 1,012,820 | 12/1911 | Cory | 273/182 R |
| 1,537,809 | 5/1925 | Easton | 273/181 A |
| 1,923,152 | 8/1933 | Kohn | 273/181 A |
| 2,224,962 | 12/1940 | Hines | 273/400 |
| 2,229,978 | 2/1972 | Salta | 273/400 |
| 2,379,663 | 7/1946 | Smith | 273/397 |
| 2,456,105 | 1/1949 | Sell | 273/181 A |
| 2,827,034 | 3/1958 | Rothe | 273/397 |
| 3,037,776 | 6/1962 | Younce | 273/397 |
| 3,156,471 | 11/1964 | Bibeau | 273/208 |
| 3,215,432 | 11/1965 | Lee | 273/29 |
| 3,328,033 | 6/1967 | Hendry | 273/182 R |
| 3,558,140 | 1/1971 | Romeo | 273/185 R |
| 3,627,327 | 12/1971 | White | 273/181 A |
| 3,758,116 | 9/1973 | Pievonek | 273/400 |
| 3,918,711 | 11/1975 | Zak | 273/181 F |
| 3,942,795 | 3/1976 | Psenka | 273/30 |

FOREIGN PATENT DOCUMENTS

| | | | |
|---|---|---|---|
| 464765 | 5/1950 | Canada | 273/394 |
| 878910 | 6/1953 | Fed. Rep. of Germany | 273/402 |
| 8236 | of 1900 | United Kingdom | 273/394 |
| 289535 | 4/1928 | United Kingdom | 273/176 FB |

OTHER PUBLICATIONS

Washington Daily News, 10/21/64.

*Primary Examiner*—Richard C. Pinkham
*Assistant Examiner*—T. Brown
*Attorney, Agent, or Firm*—Victor F. Volk

[57] ABSTRACT

An apparatus for practicing tennis has a ball receiving bin whose back wall extends upwardly to serve as a target, and whose front wall is net high. Balls entering a central hole in the target area are returned through a chute into the bin.

6 Claims, 2 Drawing Figures

TENNIS PRACTICE AND GAME APPARATUS

BACKGROUND OF THE INVENTION

Proficiency in the game of tennis requires the repeated practice of each of the strokes that are used in the game. To practice a particular stroke, however, the ball must be placed in a certain position relative to the practicer, and, if the practice takes place on a tennis court, the services of a skilled player, or pro are required to return the balls always to this position. For this reason two unskilled players cannot acquire high competence merely by "rallying" the ball back and forth between themselves. But the expense involved in hiring pros keeps most learners, particularly children, from achieving real skill in stroking. To overcome this problem automatic ball throwing machines and tennis-ball tees have been devised, but these do not solve the problem of retrieving widely scattered balls after they are hit, and, more importantly, they do not provide means for unskilled players to keep score on their improvement with practice.

One of the known tees that is most effective and that may advantageously be used in the practice of the present invention comprises a post that mounts a cross arm from which a cord is hung. A tennis ball is suspended to the end of the cord by a piece of Velcro. By a proper selection of the height of the post, and of the position of the cross arm thereon, the ball can be positioned properly for any stroke, from a low forehand to an overhead smash. But, for youngsters particularly, to maintain interest in the constant drilling on each stroke, the problem must be solved, not only of ball retrieval, but of giving the drill the aspects of a game. It is also desireable that the apparatus used should not require the space of an entire tennis court; it should, if possible, need only the space of a typical back yard, or even an unused room. The invention to be described not only requires relatively little ground area, and provides means for scoring stroking skills at widely different levels of competence in a game-like manner, but it is readily portable and can be assembled and disassembled by persons who have no particular mechanical skills.

SUMMARY OF THE INVENTION

My new and useful apparatus for practicing and evaluating tennis strokes comprises a broad, flexible sheet that is mounted substantially vertically so that it will receive and deaden the impact of a struck tennis ball. There are two openings in the sheet at different elevations. The upper opening serves as a target, and the lower opening communicates with a bin for confining spent balls. The bin is positioned immediately forward of the sheet, which may constitute its rearward wall. Chute means, which may advantageously comprise a length of sheeting enclosing both openings, and having its perimeter secured to the backward side of the broad vertical sheet, connects the two openings, so that balls entering the upper opening are delivered by gravity through the lower opening into the bin. Preferably, my apparatus is built on a frame that comprises light-weight interconnected members, such as lengths of polymeric pipe to support the broad vertical sheet and the walls of the bin. The walls of the bin are conveniently comprised of the same material as the broad vertical sheet, and the front wall should be about three feet (0.914 m.) high. Preferably, the broad sheet of my apparatus comprises a stripe just below the upper opening that defines the lower limit of a scoring zone for the placement of balls.

DETAILED DESCRIPTION OF A PREFERRED EMBODIMENT

Figure 1:
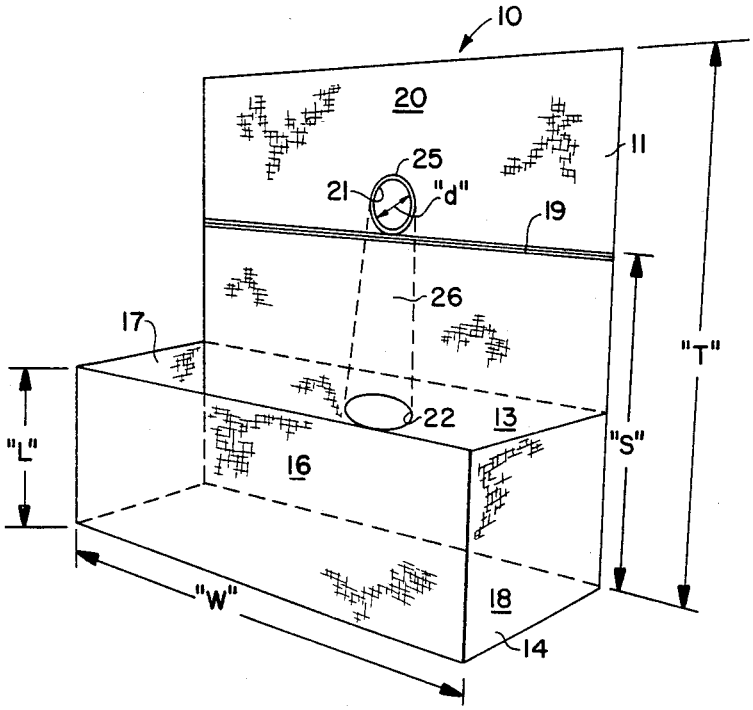
FIG. 1 shows a perspective front view of the apparatus of my invention.

FIG. 1 shows my apparatus 10 as it is set up for practicing tennis strokes or playing a game that affords such practice. The apparatus 10 has a large, broad, substantially vertical sheet 11 which may be comprised of a light canvas, although I prefer a fabric- or net-reinforced polymeric film material. Many suitable materials are commercially available. The sheeting is somewhat loosely supported on a frame structure 12, which appears in more detail in FIG. 2. The total height "T" of the sheet 11 is preferred to be about eight feet, eight inches (2.64 m.), and the width "W" about nine feet (2.74 m.). Importantly, the sheeting is slack enough to absorb the momentum of balls that strike it, so that they do not rebound. The lower portion of the broad sheet 11 constitutes a rear wall 13 of a bin 14 having a front wall 16 and side walls 17, 18 preferably made of the same sheeting as the broad sheet 11, and supported by other members of the frame structure 12. The height "L" of the wall 16 is that of a tennis net, three feet (0.914 m.), and this height is important to the purpose of my invention in that it accustomes students to stroking balls over such a net, and indeed, drop shots may be made into the bin over the wall 16 without attempting to strike the sheet 11 at all. No bottom sheet is required for the bin 14, and I prefer not to have one, since the omission saves cost and weight, but it will be understood that a bottom sheet may be included for the bin 14 within the scope of my invention. The horizontal depth "D" of my bin 14 (FIG. 2) is not finely critical, but I have preferred that "D" should be about 3½ feet (1.07 m.) although, as shall be described, I use a lesser depth for an indoor version of my apparatus.

Figure 2:
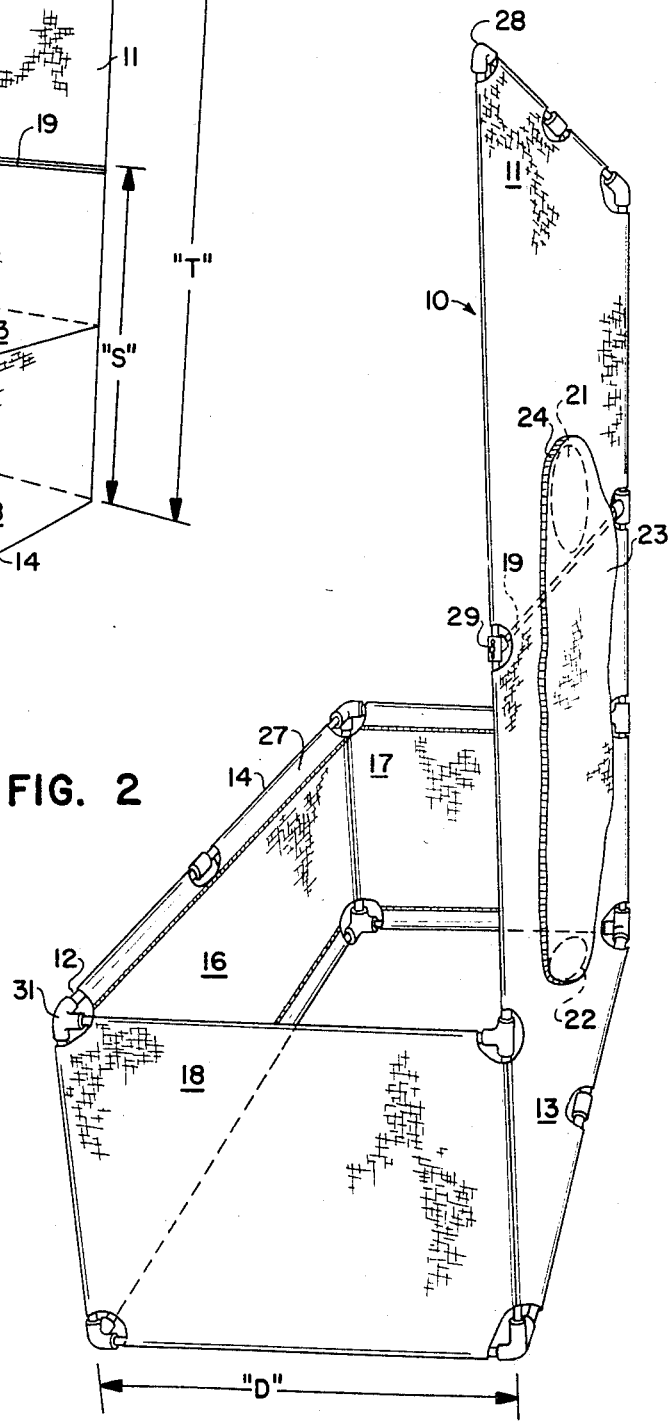
FIG. 2 shows an enlarged perspective rear view of the apparatus of FIG. 1.

A stripe 19 is painted or otherwise applied across the sheet 11 at a height "S" to its upper edge, that determines a target area 20 consisting of the portion of the sheet 11 above the stripe. Immediately above the stripe 19 a circular opening 21 through the sheet 11, with a diameter "d", constitutes a sort of "bull's eye" at which the balls are stroked, and passage through which is awarded a premium in scoring. A wide ring 25 is painted or otherwise marked around the opening 21 to enhance its visibility. I have found that the height "S" should be about 5½ feet (1.7 m.) and the diameter "d" about one foot (0.305 m.). This gives players practice in clearing the net at a safe distance, without lifting the ball so high that their oponents can gain time. In addition to the opening 21, another opening 22, large enough for tennis balls to pass freely, has been cut in the sheet 11 below the top of the bin 14. Referring to FIG. 2, a flexible chute 23, constructed of the same sheeting as the sheet 11 and the walls of the bin 14, is permanently attached to the back of the sheet 11 at a perimeter 24 that includes both the openings 21 and 22, so that balls which pass through the opening 21 will fall through the chute 23 into the bin 14. That portion 26 of the sheet 11 to which the sheeting of the chute 23 is attached forms the chute into a totally enclosed tube which keeps balls confined until they are safely in the bin 14.

The frame 12 may be made of aluminum or other metal, or wood, within the scope of my invention, but I prefer to use polyvinyl chlorid (PVC) piping which is readily available, non-corroding, inexpensive, and light in weight. Standard PVC pipe fittings, such as sleeves 27, elbows 28, T's 29, and side-outlet elbows 31 are used to join straight lengths of PVC pipe that support the sheeting, as illustrated in FIG. 2. By this means my entire apparatus 10 can be disassembled and carried in the trunk of a car. Preferably, the ends of the pipe-lengths are tapered slightly to permit hand-pressed fits into the PVC pipe fittings. The pipe lengths fit into wide hems, such as the hem 27 in the sheeting of the front wall 16 of the bin 14. In another embodiment of my invention suitable particularly for use indoors, all the features of my apparatus 10 remain as hereinbefore described except that the total height "T" is only about seven feet (2.13 m.), the diameter "d" is about 10 inches (25.4 cm.), the width "W" is about five feet (1.524 m.), and the horizontal depth "D" is about 2½ feet (0.762 m.).

In the practice of my invention I find that the best results are obtained by having the student stand on a mat that depicts proper foot-placement for the different strokes. Such mats are well known and can be purchased in tennis pro shops. One of a known group of tennis ball tees is placed in position, and the student attempts to stroke the ball so that it enters the opening 21. If his ball does enter he scores ten points, if the ball strikes the target area 20 he scores one point, otherwise he receives no score. With the described outdoor apparatus beginning players stand about ten feet (3.05 m.) away from the bin wall 16; intermediate players, about twenty feet (6.1 m.); and advanced players about 30 feet (9.15 m.). Two or more players can play a game by taking their turns and keeping score; and by appropriate handicapping players of different skills can compete, something they cannot really do by playing conventional tennis.

After extended periods of play almost all the balls will end up in the bin 14, thus saving retrieval time. While this may be an incidental advantage to adults it is a very important feature of my invention as a teaching aid for children who quickly lose interest in chasing down stray balls. The game aspect of practice with my device is also very significant for retaining the interest of children to maintain a proper schedule of practice.

I have invented a new and useful article of manufacture of which the foregoing description has been exemplary rather than definitive and for which I desire an award of Letters Patent as defined in the following claims.

I claim:

1. An apparatus for practicing and/or evaluating tennis strokes comprising:

A. a broad, flexible sheet mounted substantially vertically for receiving the impact of struck tennis balls, said sheet comprising:
   (a) a target comprising a first ball receiving opening through said sheet,
   (b) a second tennis ball receiving opening through said sheet, said second tennis ball receiving opening being lower than said first opening, B. a bin for confining spent tennis balls immediately forward of said sheet,
   (a) said sheet comprising the rear wall of said bin,
   (b) said second opening communicating with said bin, and
   (c) said bin comprising a front wall approximately 3 feet (0.91 m) high simulating a standard tennis net, and C. chute means behind said sheet, said chute means communicating between said first and said second openings whereby tennis balls entering said first opening are delivered through said second opening into said bin.

2. The apparatus of claim 1 wherein said chute means comprises a length of sheeting enclosing said first and said second openings, said sheeting being secured at its perimeter to said broad sheet.

3. The apparatus of claim 1 comprising light weight, interconnected frame members, said sheet being supported on said frame members, and said bin comprising walls supported on said frame members.

4. The apparatus of claim 3 wherein said frame members comprise lengths of polymeric piping.

5. The apparatus of claim 1 wherein said broad sheet comprises a horizontal stripe directly below said first opening, said stripe defining the lower boundry of a scoring zone for the placement of tennis balls against said broad sheet.

6. The apparatus of claim 5 wherein said stripe is about 5½ feet (1.7 m) high.

* * * * *